United States Patent [19]

Nozaka

[11] Patent Number: 4,543,152

[45] Date of Patent: Sep. 24, 1985

[54] APPARATUS FOR SPLICING SUCCESSIVE WEB ROLLS TO FEED A WEB INTO A ROTARY PRESS OR THE LIKE

[75] Inventor: Yoshiki Nozaka, Tokyo, Japan

[73] Assignee: Dai Nippon Insatsu Kabushiki Kaisha, Japan

[21] Appl. No.: 520,317

[22] Filed: Aug. 4, 1983

[30] Foreign Application Priority Data

Aug. 9, 1982 [JP] Japan ..... 57-138135

[51] Int. Cl.[4] ..... B31F 5/00

[52] U.S. Cl. ..... 156/502; 156/157; 156/504; 156/505; 156/510; 242/57; 242/58.2; 242/58.4

[58] Field of Search ..... 156/157, 159, 252, 360, 156/502, 504, 505, 510; 242/56.8, 58.1, 58.2, 58.4, 57

[56] References Cited

U.S. PATENT DOCUMENTS

| | | | |
|---|---|---|---|
| 2,939,646 | 6/1960 | Stone | 242/58.2 |
| 3,520,748 | 7/1970 | Riegger | 242/58.4 |
| 3,547,739 | 12/1970 | Beute | 156/502 |
| 3,974,490 | 8/1976 | Mori | 242/58.1 |
| 3,977,617 | 8/1976 | Salmon | 242/56.8 |
| 4,233,104 | 11/1980 | Fujishima et al. | 156/504 |
| 4,331,301 | 5/1982 | Martinez | 242/58.1 |

*Primary Examiner*—Jay H. Woo
*Assistant Examiner*—Timothy W. Heitbrink
*Attorney, Agent, or Firm*—Parkhurst & Oliff

[57] ABSTRACT

An infeed mechanism coacts with a splicer mechanism for splicing successive rolls of web and for feeding the continuous web thus obtained into a rotary press or the like via a web storage mechanism, which normally stores therein a predetermined length of the web for delivery to the press or the like during splicing operation. The infeed mechanism includes a pair of roll holder arms carrying on their opposite ends an old web roll, from which the web is being delivered to the press or the like, and a new web roll to be spliced to the old web. Toward the end of the web delivery from the old web roll the roll holder arms are turned through a pre-assigned angle, with the result that the web from the old web roll travels close to the periphery of the new web roll. Then the new web roll is revolved about its own axis until an adhesive region thereon comes opposite to the old web. Then, with the rotation of the old web roll arrested, a brush of a retractable splicer mechanism presses the old web against the adhesive region on the new web roll. Preferably an excess length of the old web behind the adhesive region is subsequently cut off by a cutter included in the splicer mechanism. Then the web delivery from the new web roll is started. The complete operation can be automated.

16 Claims, 25 Drawing Figures

APPARATUS FOR SPLICING SUCCESSIVE WEB ROLLS TO FEED A WEB INTO A ROTARY PRESS OR THE LIKE

BACKGROUND OF THE INVENTION

This invention relates to a method of, and apparatus for, feeding a continuous web of paper or like material into a rotary press or other machine. More specifically the invention concerns such a method and apparatus featuring the automatic splicing of successive rolls of web without the need for suspending the feeding of the web into the rotary press or the like.

Although the method and apparatus of this invention have particular utility in conjunction with web-fed rotary presses, they lend themselves to use with a web coater, corrugator, or any other machine which either consumes or processes continuous webs. Thus, hereinafter in this specification and in the claims appended thereto, all such machines to which the invention finds applications will be generally referred to as "web consuming or processing machines". Further the terms "old web" and "old web roll" will be used herein and in the claims appended hereto to mean the web and roll, respectively, that have been being consumed or processed. The terms "new web" and "new web roll" signify the fresh web and roll, respectively, that are to be, or being, spliced to the old web or roll.

Two methods have been known for splicing successvie rolls of web without suspending the feeding of the web into the consuming or processing machine. One is called the "zero speed method", such that the old and new rolls of web are both held out of rotation during splicing. The other is the "speed matching method" wherein the new web roll is revolved at a peripheral speed equal to the running speed of the old web for splicing them at zero relative speed. A more extensive discussion of these prior art splicing methods follows.

U.S. Pat. No. 4,233,104 describes and claims apparatus constructed to carry the zero speed method into practice. The apparatus broadly comprises an infeed mechanism for feeding a web into a consuming or processing machine, a splicer mechanism incorporated with the infeed mechanism for splicing successive rolls of the web, and a web storage mechanism interposed between the infeed mechanism and the consuming or processing machine for holding a required length of the web for delivery to the consuming or processing machine during the splicing of successive web rolls.

The infeed mechanism has a pair of roll holder arms medially pivoted for joint rotation. The roll holder arms carry old and new web rolls on their opposite ends, and the splicer mechanism therebetween. The splicer mechanism includes a pair of nip rolls movable toward and away from each other and having suction ports created therein. Upon decrease of its radius to a prescribed degree the old web becomes locked against rotation to discontinue the payoff of the web therefrom and hence to allow this web to be spliced to the new web. During the subsequent splicing operation the web storage mechanism operates to feed the web length that has been stored therein into the consuming or processing machine.

The new web roll has attached to its leading end a piece of tape having adhesive layers on its opposite faces. This taped end of the new web is held by suction against one of the nip rolls of the splicer mechanism. The old web is wrapped around the other nip roll on its way toward the web storage mechanism. The old and new webs can therefore be joined together via the adhesive tape by pressing the nip rolls against each other. The old web is cut off from its roll by a knife positioned adjacent the nip rolls. Then the infeed mechanism resumes the feeding of the web from the new roll.

The speed matching method, on the other hand, also dictates the use of an infeed mechanism comprising a pair of rotatable roll holder arms, but of no web storage mechanism. The roll holder arms rotatably carry old and new web rolls on their opposite ends. During normal feeding operation the roll holder arms extend approximately vertically, with the old web roll held above and the new web roll below. Upon decrease in the radius of the old web roll to a predetermined degree the roll holder arms are turned approximately 180 degrees, so that the new web roll comes above and the old one comes below.

Disposed above the roll holder arms is a speed matching mechanism including a drive roll which is movable into and out of peripheral contact with the new web roll. At the time of splicing, the drive roll revolves the new web roll about its own axis at a peripheral speed equal to the running speed of the old web traveling therepast.

Also disposed adjacent the roll holder arms is a retractable splicer mechanism which, when in its working position, guides the old web thereover so as to pass substantially tangentially of the new web roll. As the peripheral speed of the new web roll becomes equal to the running speed of the old web as above, the splicer mechanism presses, with a brush incorporated therein, the old web against an adhesive region at the leading end of the new web. Then the old web is severed from its roll by a knife disposed adjacent the splicer brush. Thus the infeed mechanism commences the payoff of the web from the new roll whereas the splicer mechanism returns to its retracted position.

The zero speed and speed matching schemes, as practiced heretofore, have their own drawbacks. In the apparatus built on the zero speed scheme the old and new webs are joined together by the pair of nip rolls spaced from their rolls. This requires the manual threading of the leading end of each new web, with an adhesive tape attached thereto, between the nip rolls, thus making difficult the full automation of the apparatus. The adhesive tape, moreover, must be attached to the new web roll on the splicer mechanism; it cannot be applied to new web rolls preparatory to their mounting on the apparatus.

The apparatus embodying the speed matching scheme, on the other hand, requires the expensive speed matching mechanism for precisely synchronizing the peripheral speed of the new web roll with the running speed of the old web. The speed matching method is also more difficult to practice than the zero speed method. The successive web rolls are likely to be spliced improperly, or not spliced at all, if the leading end of the new web roll comes off during the rotation of the roll or if its peripheral speed does not equal to the running speed of the old web by reason of, for example, the eccentricity of the new web roll. Further the old web has a considerable length of its portion trailing behind the region where it is adhered to the new web. The length of this trailing end portion should be reduced to a minimum so as not to interfere with the operation of the web consuming or processing machine.

It is also a disadvantage of the speed matching method that the adhesive region or regions on the leading end of each new web must be of very complex pattern in order to afford a firm bond to the old web, since the webs are spliced while running. The preparation of such complex adhesive regions is of course a troublesome and time consuming job which is difficult of automation.

The prior art web feeders built on both the zero speed and the speed matching schemes have an additional problem in common with regard to the alignment of the successive web rolls. The aforesaid pair of roll holder arms have two pairs of opposed chucking cones on their opposite ends for engagement in the respective hollow cores of the old and new web rolls.

No alignment problem would occur if all the web rolls had their webs rolled in the same axial position on the hollow cores. Actually, however, some axial displacement of the webs on the cores is usual. Should these web rolls be spliced with the axial displacement of the webs uncorrected, the successive lengths of the web would have corresponding lateral displacement. Let us consider the case where the web is fed into an offset printing press. Passing between the blanket cylinders of the press, the laterally displaced length of the web would be caught between the ink piles of the cylinders and so might partly be cut off, or at least the image would be printed out of place on the web.

Conventionally, therefore, it has been the duty of a pressman to visually examine the axial position of each new web roll on its core and, as required, to manually shift the web roll axially on the core. The manual labor, of course, runs counter to the desired higher production of the press.

A still further problem with the prior art concerns the means for preventing the end of each web roll from coming off the roll. Taping is the usual expedient to this end. The web end, however, must readily come off the roll when spliced to the old web. The conventional practice has been to apply relatively wide, strong tape to each web roll to prevent the loosening of its end during transportation and handling. The strong tape is peeled off the web roll just before its use, and narrower, easier-to-break tape is applied in several spaced apart positions across the web end. However, the narrower tape as heretofore used has been too weak to hold the web end against the roll and has been easy to break during the handling of the roll as for mounting the same on the pair of roll holder arms.

SUMMARY OF THE INVENTION

The present invention overcomes the weaknesses of, and derives strengths from, the known zero speed scheme and speed matching scheme in providing an improved method of, and apparatus for, positively and accurately splicing rolls of web one after another and continuously feeding the web into a desired web consuming or processing machine. The method and apparatus in accordance with the invention are based upon an improved version of the zero speed scheme as both old and new webs are held stationary during splicing.

More specifically the method and apparatus in accordance with the invention are well calculated to allow full automation of the web splicing and feeding operations.

Further the invention solves the problem of how to automatically align the successive web rolls in splicing them, in order to assure proper consumption or processing by the web consuming or processing machine.

Still further the invention makes it possible to firmly hold the end of each web roll in position on the roll during its transportation and handling but, nevertheless, to allow the web end to readily come off the roll on being spliced to the old length of web.

According to the improved method of this invention, summarized in brief, an old web roll and a new web roll are rotatably mounted on the opposite ends of a pair of roll holder arms which are medially pivoted for joint rotation. The roll holder arms are held in a first preassigned angular position as the web from the old web roll is fed into a desired web consuming or processing machine via a web storage mechanism in which a prescribed length of the web from the old web roll is normally stored. Toward the end of the web delivery from the old web roll, the roll holder arms are turned from the first to a second preassigned angular position where the web from the old web roll travels close to the periphery of the new web roll. Then the new web roll is revolved relative to the roll holder arms through an angle required to bring an adhesive region on the leading end of the new web to a prescribed position opposite to the old web traveling past the new web roll. Then, with the old web roll locked against rotation relative to the roll holder arms, the old web is pressed against the adhesive region on the new web roll. Thus spliced onto the old web, the new web roll starts feeding the web consuming or processing machine, which has been fed from the web storage mechanism during the splicing operation. As required, the old web may be cut off from its roll after having been spliced to the new web.

Thus the improved method of this invention combines the advantages of the conventional zero speed scheme and speed matching scheme and eliminates their disadvantages, making it possible to firmly splice successive web rolls and uninterruptedly feed the web into a desired web consuming or processing machine through a full automatic sequence.

Another aspect of the invention concerns apparatus for use in the practice of the above outlined method. The apparatus comprises an infeed mechanism for feeding a continuous web from successive rolls to a web consuming or processing machine, a splicer mechanism for splicing the successive web rolls in coaction with the infeed mechanism, and a web storage mechanism interposed between the infeed mechanism and the web consuming or processing machine for feeding the latter during the splicing of the successive web rolls. The infeed mechanism includes a pair of roll holder arms arranged in parallel spaced relation to each other and medially pivoted for joint rotation. An old web roll and a new web roll are rotatably mounted on the opposite ends of the roll holder arms. The infeed mechanism further comprises first drive means for controllably revolving the roll holder arms, second drive means for controllably revolving each of the old and new web rolls relative to the roll holder arms, sensor means for sensing an adhesive region on the leading end of the new web and for causing the second drive means to revolve the new web roll until the adhesive region thereon comes opposite to the old web traveling past the new web roll, and brake means for controlling the rotation of each of the old and new web rolls. The splicer mechanism is normally held retracted away from the roll holder arms. Immediately after the roll holder arms are turned from the first to the second preassigned angular position, as has been stated in the summary of the inventive method, the splicer mechanism is moved from the retracted position to a working position for pressing the web from the old web roll against the adhesive region on the new web roll.

The apparatus of the above broad construction is believed to represent the best mode of carrying out the inventive method. Its operation can of course be fully automated, and no difficulties such as those encountered heretofore and pointed out earlier in this specification will occur in the operation of the apparatus.

The above and other features and advantages of this invention and the manner of attaining them will become more apparent, and the invention itself will best be understood, from a study of the following description and appended claims, with reference to the attached drawings showing some preferable embodiments of the invention.

DETAILED DESCRIPTION OF THE INVENTION

The apparatus in accordance with the invention broadly comprises an infeed mechanism 1 and a web storage mechanism 2. The infeed mechanism 1 delivers a continuous web W of paper or the like by splicing successive web rolls R1 and R2 in coaction with a splicer mechanism 25. Interposed between this infeed mechanism 1 and a web consuming or processing machine, not shown, the web storage mechanism 2 normally holds in storage a prescribed length of the web W from the infeed mechanism, for feeding the web consuming or processing machine during the splicing of the successive web rolls.

Figure 1:
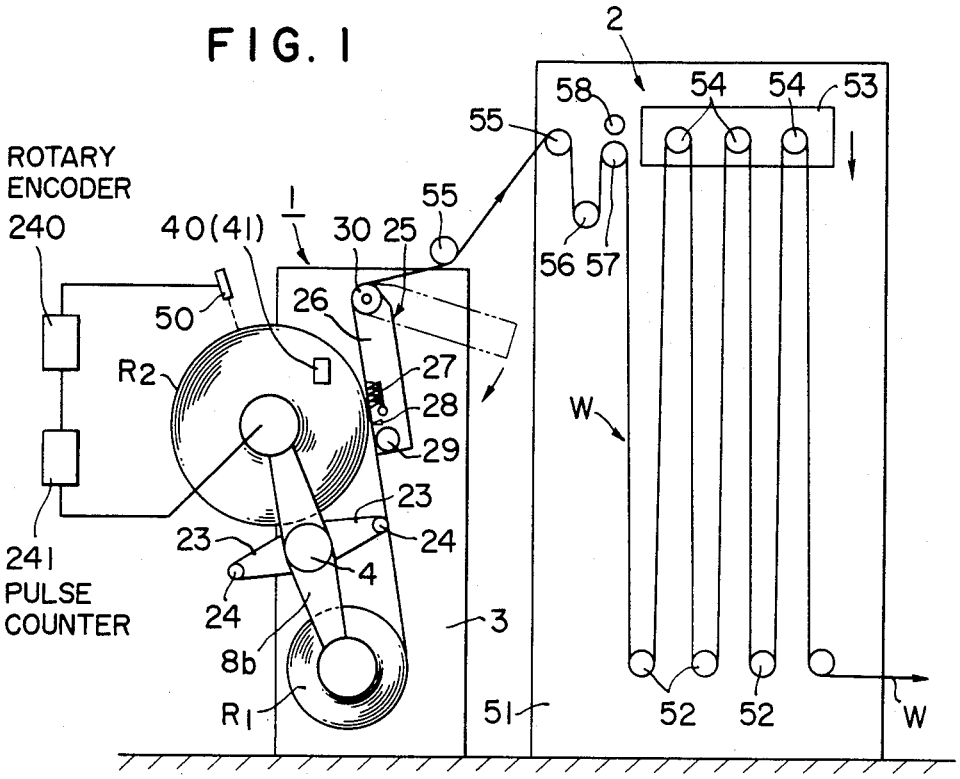
FIG. 1 is a diagrammatic representation of the general organization of the apparatus constructed in accordance with the novel concepts of this invention.
Figure 2:
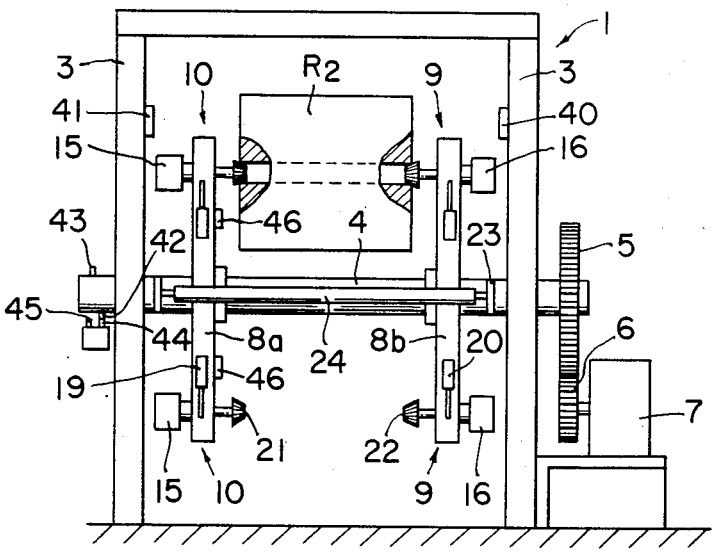
FIG. 2 is an elevation of the apparatus as seen from the left hand side of FIG. 1, the view showing only the infeed mechanism of the apparatus.

Reference is directed to both FIGS. 1 and 2 in order to discuss the construction of the infeed mechanism 1. It has a pair of side frames 3 supporting a rotary shaft 4 extending horizontally therebetween. The rotary shaft 4 has fixedly mounted thereon a pair of roll holder arms 8*a* and 8*b* in parallel spaced relation to each other. Rotatably supported between the opposite ends of the roll holder arms 8*a* and 8*b* are the old web roll R1, from which the web W is being fed into the unshown consuming or processing machine, and the new web roll R2 to be spliced to the web from the old web roll.

The right hand end of the rotary shaft 4, as seen in FIG. 2, projects beyond one of the side frame 3 and has a driven gear 5 nonrotatably mounted thereon. The driven gear 5 meshes with a drive pinion 6 on the output shaft of a motor drive unit 7. This motor drive unit functions to controllably revolve the roll holder arms 8*a* and 8*b* via the shaft 4, so that it will hereinafter be referred to as the arm motor.

Also as shown in FIG. 2, the left hand roll holder arm 8*a* has a pair of roll support mechanisms 10 on its opposite ends, and the right hand roll holder arm 8*b* has a pair of roll support mechanisms 9 on its opposite ends. The two pairs of roll support mechanisms 9 and 10 conjointly support, and control the rotation of, the old R1 and new R2 web rolls.

Figure 3:
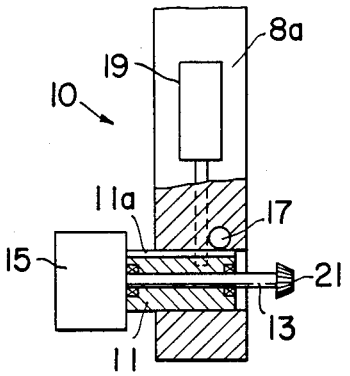
FIG. 3 is an enlarged, fragmentary elevation, partly sectioned for clarity, of one of the pair of roll holder arms together with one of the pair of roll support mechanisms mounted thereon, in the infeed apparatus of FIG. 2.

FIG. 3 is an enlarged detail view of one of the roll support mechanisms 10 on the left hand roll holder arm 8*a*. Included is a spindle 13 rotatably mounted in a sleeve 11 which is slidably engaged in an opening formed through the roll holder arm 8*a* and which is constrained to linear reciprocation relative to the roll holder arm 8*a* toward and away from the other roll holder arm 8*b*. The spindle 13 has its left hand or outer end coupled to a clutch motor 15 (i.e. an electric motor with a clutch) which is supported by the sleeve 11 for joint back-and-forth travel therewith. The right hand or inner end of the spindle 13, on the other hand, rigidly carries a chucking cone 21 for engagement in one end of the usual hollow core of each web roll. The sleeve 11 has a series of rack teeth 11*a* formed thereon for engagement with a pinion 17 rotatably mounted to the roll holder arm 8*a*. This pinion 17 meshes with another set of rack teeth formed on the output shaft of a fluid actuated cylinder 19 on the roll holder arm 8*a*.

Figure 4:
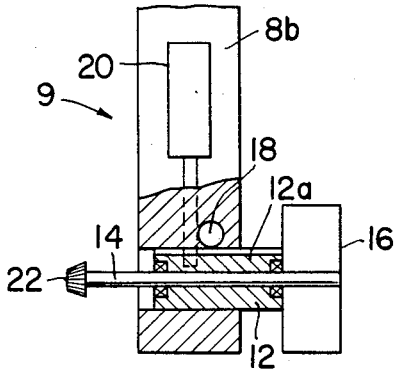
FIG. 4 is a view similar to FIG. 3 but showing the other of the pair of roll holder arms together with one of the other pair of roll support mechanisms mounted thereon.

A study of FIG. 4 in comparison with FIG. 3 will reveal that each roll support mechanism 9 on the other roll holder arm 8*b* is essentially identical in construction with each roll support mechanism 10 except for an electromagnetic brake 16 used in place of the clutch motor 15. Thus the roll support mechanism 9 also comprises a spindle 14 having a chucking cone 22 on its inner end and coupled at its outer end to the electromagnetic brake 16, a sleeve 12 rotatably fitted over the spindle 14 and having a series of rack teeth 12*a* in engagement with a pinion 18, and a fluid actuated cylinder 20 for imparting bidirectional rotation to the pinion 18.

It is now seen that each opposed pair of roll support mechanisms 9 and 10 rotatably hold one web roll therebetween by the engagement of their chucking cones 21 and 22 in the hollow core of the web roll. The chucking cones are readily engageable in and disengageable from the web roll core by the extension and contraction of the fluid actuated cylinders 19 and 20. The clutch motor 15 and electromagnetic brake 16 control the rotation of the web roll relative to the roll holder arms 8*a* and 8*b* in a manner to be detailed subsequently.

With reference back to FIGS. 1 and 2 the rotary shaft 4 has two pairs of support arms 23 rigidly mounted thereon in the vicinities of its opposite ends. Extending in the opposite directions from the rotary shaft 4, and in right angular relation to the pair of roll holder arms 8*a* and 8*b*, the two pairs of support arms 23 rotatably support guide rolls 24 between their distal ends. The guide rolls 24 extend parallel to the rotary shaft 4. During splicing operation either of these guide rolls functions to guide the web from the old web roll R1 to the splicer mechanism 25, as in FIG. 1.

Figure 5:
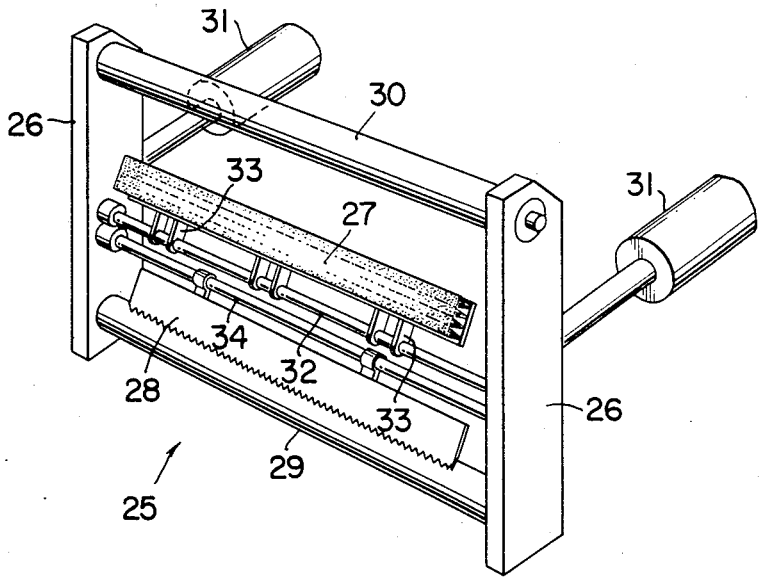
FIG. 5 shows in perspective and on an enlarged scale the splicer mechanism seen in FIG. 1.

The splicer mechanism 25 is illustrated in detail in FIG. 5. It includes a pair of parallel spaced frame members 26 mounted each at one end to the respective side frames 3 of the infeed mechanism 1 for joint pivotal motion about a horizontal axis above the roll holder arms 8*a* and 8*b*. Supported between the pair of opposed frame members 26 are a splicer brush 27, a cutter 28, and two guide rolls 29 and 30.

For pressing the web from the old web rolls R1 against an adhesive region on the new web roll R2, the splicer brush 27 is mounted via support arms 33 on a rotary shaft 32 thereby to be pivoted toward and away from the new web roll when the latter is in the position of FIGS. 1 and 2. The cutter 28 takes the form of a strip of suitable material, having a cutting edge along one of its opposite longitudinal sides for severing the old web after it has been spliced to the new web roll. This cutter is likewise mounted on another rotary shaft 34 for pivotal motion between working and retracted positions relative to the frame members 26. These brush shaft 32 and cutter shaft 34 are to be rotated bidirectionally by suitable actuators such as solenoids, not shown.

The guide roll 29 extends between the distal, free ends of the frame members 26, so that it functions to guide the web from the old web roll R1 only when the splicer mechanism 25 lies in the working position depicted by the solid lines in FIG. 1. Extending between the proximal ends of the frame members 26, on the other hand, the other guide roll 30 is concentric with the aligned pivots of the frame members. Consequently the guide roll 30 serves to guide the web from either the old R1 or new R2 web rolls regardless of whether the splicer mechanism 25 is in the working or a retracted position, the latter position being indicated by the phantom lines in FIG. 1.

The splicer mechanism 25 has a pair of fluid actuated cylinders 31 pivotally linked to its frame members 26. These cylinders operate to move the splicer mechanism between the working and retracted positions of FIG. 1.

A reference back to FIGS. 1 and 2 will reveal that a light source 40 and photodetector 41 are mounted to the respective side frames 3 of the infeed mechanism 1 in opposed relation to each other. The light source 40 emits a coherent beam of light which normally impinges upon the photodetector 41, with the result that the actuating cylinders 31 of the splicer mechanism 25 are held contracted to maintain the splicer mechanism in the retracted position. As the new web roll R2 on the roll holder arms 8*a* and 8*b* intercepts the light beam from the light source 40, the cylinders 31 extend to swing the splicer mechanism 25 from the retracted position to the working position. A limit switch, not shown, senses the movement of the splicer mechanism 25 to the working position and sets the cylinders 31 out of operation.

It will be observed from FIG. 2 the rotary shaft 4 of the infeed mechanism 1 has two switch actuator studs 42 and 43 on its left hand end with a circumferential spacing of 180 degrees and with some axial spacing. Arranged in juxtaposition for actuation by the switch actuator studs 42 and 43 are Microswitches 44 and 45 connected in circuit with the motor drive unit 7 and clutch motors 15. Upon actuation of either of the Microswitches 44 and 45 by the corresponding one of the studs 42 and 43, the motor drive unit 7 sets the pair of roll holder arms 8*a* and 8*b* out of rotation, and one of the clutch motors 15 operates to revolve the new web roll R2 in a predetermined direction.

Figure 7:
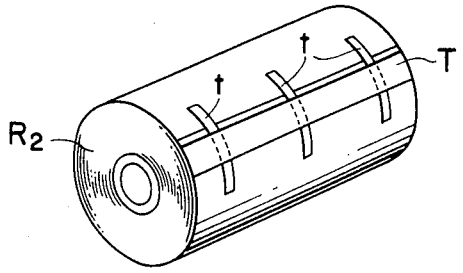
FIG. 7 shows in perspective a roll of web suitable for use with the apparatus of FIG. 1.

FIG. 1 indicates at 50 a phototube for optically sensing the adhesive region T, FIG. 7 on the new web roll R2 on the roll holder arms 8*a* and 8*b* from the difference in reflectivity. Instead of the phototube 50, a magnetic sensor can be used. In this case, a piece of magnetic tape is applied to the region T. The phototube 50 is electrically connected to any suitable control circuit which may comprise a rotary encoder 240 and pulse counter 241. Mounted to the spindle 13, FIG. 3, of each roll support mechanism 10, the rotary encoder 240 generates a succession of pulses when energized by the phototube 50 upon its detection of the adhesive region T on the new web roll R2. The pulse counter 241 counts the number of the incoming encoder output pulses. Upon counting a predetermined number of the input pulses the pulse counter 241 causes the corresponding one of the clutch motors 15 to terminate the rotation of the new web roll R2 in coaction with the corresponding one of the electromagnetic brakes 16. Thereupon the adhesive region T on the new web roll R2 will lie opposite to the web extending therepast from the old web roll R1 or, more precisely, will come to a position of register with the splicer brush 27 of the splicer mechanism 25 in its working position, as will be explained in more detail in the subsequent description of operation.

The web storage mechanism 2 seen in FIG. 1 can be of conventional design. As illustrated, the web storage mechanism has a pair of opposed side frames 51, one shown, between which there are supported a set of fixed guide rolls 52 and a set of movable guide rolls 54. The movable guide rolls 54 are mounted to a floating carriage 53 for up and down motion toward and away from the fixed guide rolls 52. The web W paid off by the old web roll R1 is threaded in a zigzag fashion over the fixed and movable guide rolls 52 and 54.

A known position control mechanism, not shown, is coupled to the floating carriage 53 for controllably moving the same up and down. The floating carriage 53 travels upward when the rate of web delivery from infeed mechanism 1 to storage mechanism 2 exceeds the rate of web delivery from storage mechanism to consuming or processing machine, and downward when the other way around. Normally the floating carriage 53 is held in the most elevated position for storing a predetermined length of the web W, which is to be fed out into the consuming or processing machine during the next web splicing operation.

Disposed upstream of the zigzag web passageway in the storage mechanism 2 are two guide rolls 55, a tension sensor roll 56, a high speed feed roll 57, and a nip roll 58. The tension sensor roll 56 senses the tension of the web W from infeed mechanism 1 to storage mechanism 2 and causes one of the electromagnetic brakes 16, FIGS. 2 and 4, to brake the rotation of the old web roll R1 accordingly. After each splicing operation, when the floating carriage 53 is lowered, the nip roll 58 is to be moved into frictional engagement with the high speed feed roll 57 via the web W. Thereupon the feed roll 57 is to be set into rotation at high speed to pull the web from the new web roll at a rate greater than the rate of web delivery from storage mechanism 2 to consuming or processing machine. Thus the storage mechanism 2 can again store the required extra length of the web therein despite the uninterrupted web delivery therefrom to the consuming or processing machine.

Operation

The operation of the apparatus constructed as in FIGS. 1 through 5 will be best understood by reference to FIGS. 6A through 6D. The following operational description of the apparatus is intended also to serve as a detailed disclosure of the method of this invention.

Figure 6A:
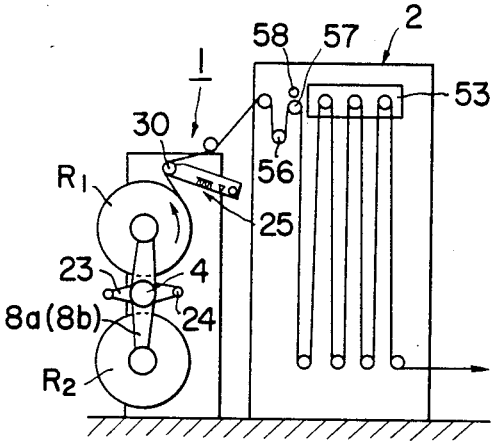
FIGS. 6A through 6D are a series of diagrammatic representations similar to FIG. 1 and explanatory of the operation of the apparatus.

FIG. 6A represents the apparatus in a state just after the splicing of a new web roll. This web roll, designated R1, will hereinafter be called the old web roll since the web is being delivered therefrom to the consuming or processing machine via the web storage mechanism 2. The pair of roll holder arms 8*a* and 8*b* are now in their first preassigned angular position, which is shown to be approximately vertical, and the old web roll R1 is caught between the upper ends of the roll holder arms.

The splicer mechanism 25 is retracted. The floating carriage 53 of the web storage mechanism 2 is in the most elevated position, so that the full required length of the web is stored in the storage mechanism.

FIG. 6A further shows a new web roll R2 mounted between the lower ends of the roll holder arms 8*a* and 8*b*. For thus mounting the new web roll it may be placed on a suitable carriage and held in position between the lower ends of the roll holder arms. Then, by activating the cylinders 19 and 20, FIGS. 2 through 4, on the lower ends of the roll holder arms, the corresponding chucking cones 21 and 22 are forced into engagement in the opposite ends of the hollow core of the new web roll.

Figure 6B:
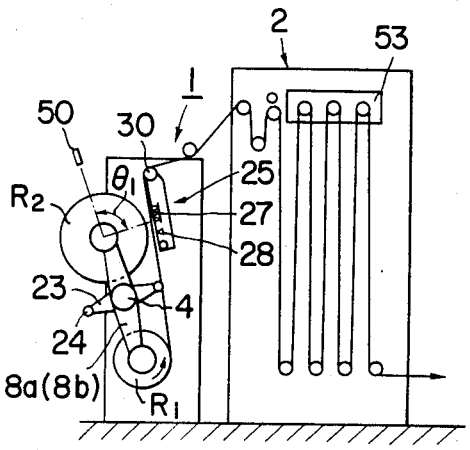

Toward the completion of the web delivery from the old web roll R1, when its radius decreases to a prescribed degree, tha arm motor 7, FIG. 2, is set into rotation to revolve the roll holder arms 8*a* and 8*b* in the clockwise direction, as viewed in FIG. 6A, around the rotary shaft 4 to a second preassigned angular position given in FIG. 6B. Upon revolution of the roll holder arms through the required angle one of the switch actuator studs 42 and 43 on the rotary shaft 4 activates the corresponding one of the Microswitches 44 and 45 thereby setting the arm motor 7 out of rotation.

In the second preassigned angular position of the roll holder arms 8*a* and 8*b*, the old web roll R1 approximately underlies the new web roll R2. The web from the old web roll R1 passes close to the periphery of the new web roll R2, by being guided by the guide roll 24 on one of the support arms 23 on the rotary shaft 4 and the guide roll 30 of the splicer mechanism 25, as it travels toward the web storage mechanism 2. The second preassigned angular position is so determined that the spacing between the periphery of the new web roll R2 and the old web traveling therepast is from five to 15 millimeters.

As has been stated with reference to FIG. 7, the new web roll R2 has the adhesive region T on the leading end of the web. The adhesive region may be formed by attaching a suitable length of tape that has adhesive layers on its opposite faces to the leading end of the web so as to extend along its edge in the axial direction of the roll. Further, as shown also in FIG. 7, several pieces of narrower adhesive tape t are affixed to the roll to hold the leading web end in position thereon.

Then, in the state of FIG. 6B, the clutch motor 15 associated with the new web roll R2 is energized to revolve the new web roll until the adhesive region T thereon comes opposite to the phototube 50. After the detection of the adhesive region by the phototube the circuit comprising the rotary encoder 240 and pulse counter 241 causes the clutch motor 15 to revolve the new web roll R1 in the clockwise direction through an angle $\theta 1$ that has been determined in accordance with the radius of the new web roll. Thus the adhesive region T on the new web roll R2 comes to the preassigned position opposite to the old web traveling past the new web roll. By this time the splicer mechanism 25 has been swung from the retracted position to the working position as in FIG. 6B. The noted preassigned position of the adhesive region T corresponds exactly to the splicer brush 27 of the splicer mechanism 25 in its working position.

Upon further decrease in the radius of the old web roll R1 with the continued web delivery therefrom, the old web roll becomes locked against rotation by the electromagnetic brake 16 associated therewith. Thereupon the floating carriage 53 of the web storage mechanism 2 starts descending to allow the stored extra length of the web to be fed into the consuming or processing machine. Following the cessation of the web delivery from the old web roll R1 the splicer brush 27 is activated by the unshown solenoid or the like to press the old web against the adhesive region T on the new web roll R2. Immediately after the activation of the splicer brush the cutter 28 is likewise activated to cut off an excess length of the old web behind the adhesive region T to which it has been attached.

Figure 6C:
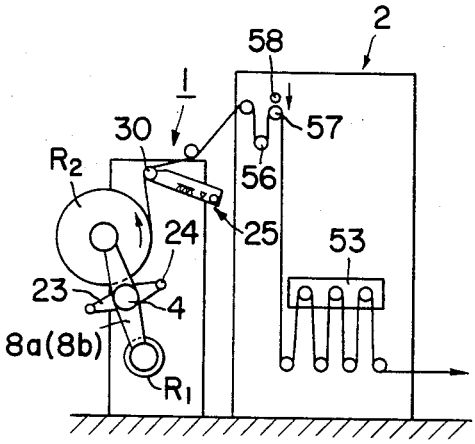

FIG. 6C shows the apparatus in a state upon completion of the splicing operation. The splicer mechanism 25 has been retracted. The floating carriage 53 of the web storage mechanism 2 is still in its lowermost position since it has been feeding the web consuming or processing machine during the splicing operation. Although the infeed mechanism 1 has resumed web delivery from the new web roll R2, the storage mechanism 2 is incapable of storing the web unless, as has been mentioned, the rate of web delivery from infeed mechanism to storage mechanism is higher than that from storage mechanism to consuming or processing machine.

Thus, in FIG. 6C, the nip roll 58 is shown pressed against the high speed feed roll 57 via the web from the new web roll R2. The feed roll 57 rotates to deliver the web to the storage mechanism 2 at a higher rate than that of web consumption or processing by the consuming or processing machine. The floating carriage 53 of the storage mechanism 2 starts ascending with the commencement of the high speed web delivery from the infeed mechanism 1.

Figure 6D:
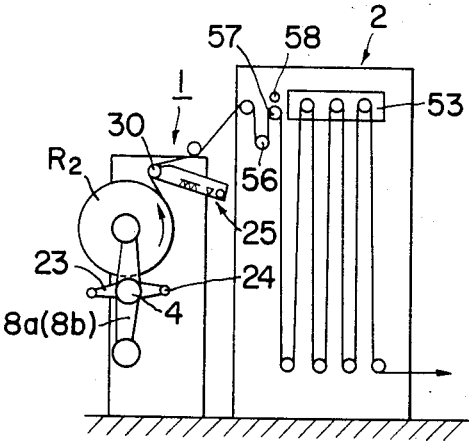

In FIG. 6D the floating carriage 53 is shown subsequently returned to its most elevated position upon completion of the storage of the required length of the web in the storage mechanism 2. The nip roll 58 moves away from the high speed feed roll 57, and the latter terminates the high speed web delivery from the infeed mechanism 1. Then, sensing the tension of the web, the tension sensor roll 56 causes the electromagnetic brake 16 associated with the web roll R2 to control its rotation for normal web delivery to the consuming or processing machine.

It will be noted from FIG. 6D that the roll holder arms 8*a* and 8*b* are slightly turned in the clockwise direction from their second preassigned angular position of FIGS. 6B and 6C. A new web roll is to be mounted between the lower ends of the roll holder arms, as in FIG. 6A, when they are in the FIG. 6D position.

The apparatus repeats the foregoing cycle of operation for splicing the successive web rolls and uninterruptedly feeding the continuous length of web into the desired consuming or processing machine. It will be appreciated that the method and apparatus of this invention make possible the positive splicing of the successive web rolls as, during such splicing, the old web roll is held against rotation, and the adhesive region on the new web roll is automatically moved to the predetermined angular position opposite to the old web extending past the new web roll. No web manipulation is necessary. Thus the invention thoroughly overcomes the above enumerated drawbacks of the known zero speed method and speed matching method.

Modifications of the First Form

Figure 8:
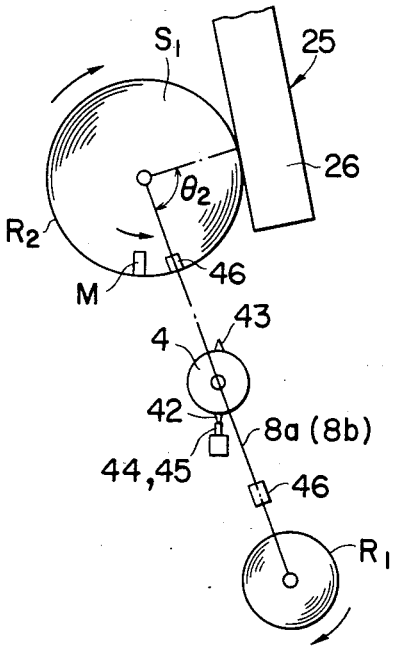
FIG. 8 is a diagrammatic representation of alternate means for bringing an adhesive region on the new web roll to a position opposite to the splicer mechanism.

FIG. 8 illustrates an alternative arrangement for automatically adjusting the angular position of the adhesvie region on each new web roll to the brush of the splicer mechanism 25. The new web roll R2 has a readily optically recognizable mark M attached to one of its opposite ends in a position corresponding to that of the adhesive region thereon. For sensing this mark M two phototubes 46 are mounted to one of the roll holder arms 8*a* and 8*b*, as indicated also in FIG. 2. Thus this modified embodiment proposes the detection of the mark M on the new web roll by either of the two phototubes 46 instead of the direct sensing of the adhesive region as in the preceding embodiment.

After the roll holder arms 8*a* and 8*b* are stopped in their second preassigned angular position by the engagement of one of the studs 42 and 43 on the rotary shaft 4 with the corresponding one of the Microswitches 44 and 45, as has been described in connection with FIG. 6B, the new web roll R2 is revolved about its own axis by one of the clutch motors 15. The revolution of the new web roll R2 may be arrested after it has turned through a preset angle $\theta 2$ following the detection of the mark M by one of the phototubes 46. Then the adhesive region on the new web roll will be positioned opposite to the brush of the splicer mechanism 25.

Figure 9:
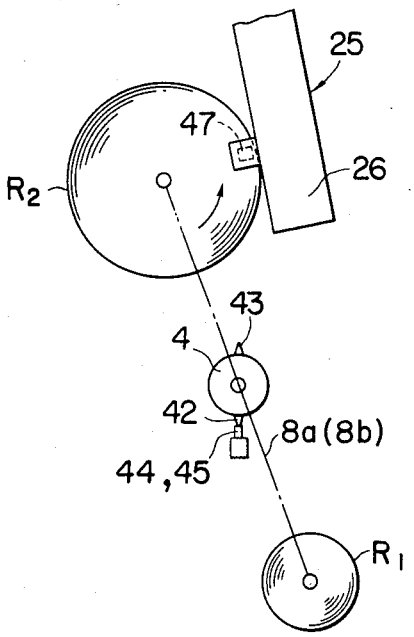
FIG. 9 is a similar representation of additional means alternative to the means of FIG. 8.

In another modified arrangement given in FIG. 9 a phototube 47 is mounted to one of the frame members 26 of the splicer mechanism 25 for sensing the mark M attached to the new web roll R2 as in the embodiment of FIG. 8. In this case the rotation of the new web roll about its own axis may be arrested immediately upon detection of the mark M by the phototube 47.

Second Form

FIGS. 10 through 15 are devoted to a second preferred form of the apparatus in accordance with the invention. This second preferred form features facilities for automatically aligning successive web rolls, or eliminating their relative displacement in the width direction of the web, preparatory to splicing them. The alternative apparatus also broadly comprises an infeed mechanism, a splicer mechanism, and a web storage mechanism. However, since the splicer mechanism and web storage mechanism can be identical with those of the embodiment of FIGS. 1 through 7, the infeed mechanism only will be described in detail.

The modified infeed mechanism is generally labeled 1 in FIG: 10. It has the pair of side frames 3 supporting the rotary shaft 4 therebetween as in the preceding embodiment. In this alternate embodiment, however, the pair of roll holder arms 8*a* and 8*b* are mounted on the rotary shaft 4 for movement toward and away from each other while being capable of joint rotation with the rotary shaft. Provided for such axial motion of each roll holder arm relative to the rotary shaft 4 is a rack 60 on the rotary shaft and a hand-driven pinion 61 on each roll holder arm. The rack 60 meshes with the pinion 61. By manually revolving the pinion 61, therefore, each roll holder arm is adjustably movable toward and away from the other on the rotary shaft 4.

A pair of adjustable roll support mechanisms 62 and 63 are mounted on the opposite ends of the left hand roll holder arm 8*a*. These roll support mechanisms coact with a complementary pair of roll support mechanisms 99 and 100 on the right hand roll holder arm 8*b* in adjustably varying the axial positions of the web rolls between the roll holder arms.

Figures 11, 12:
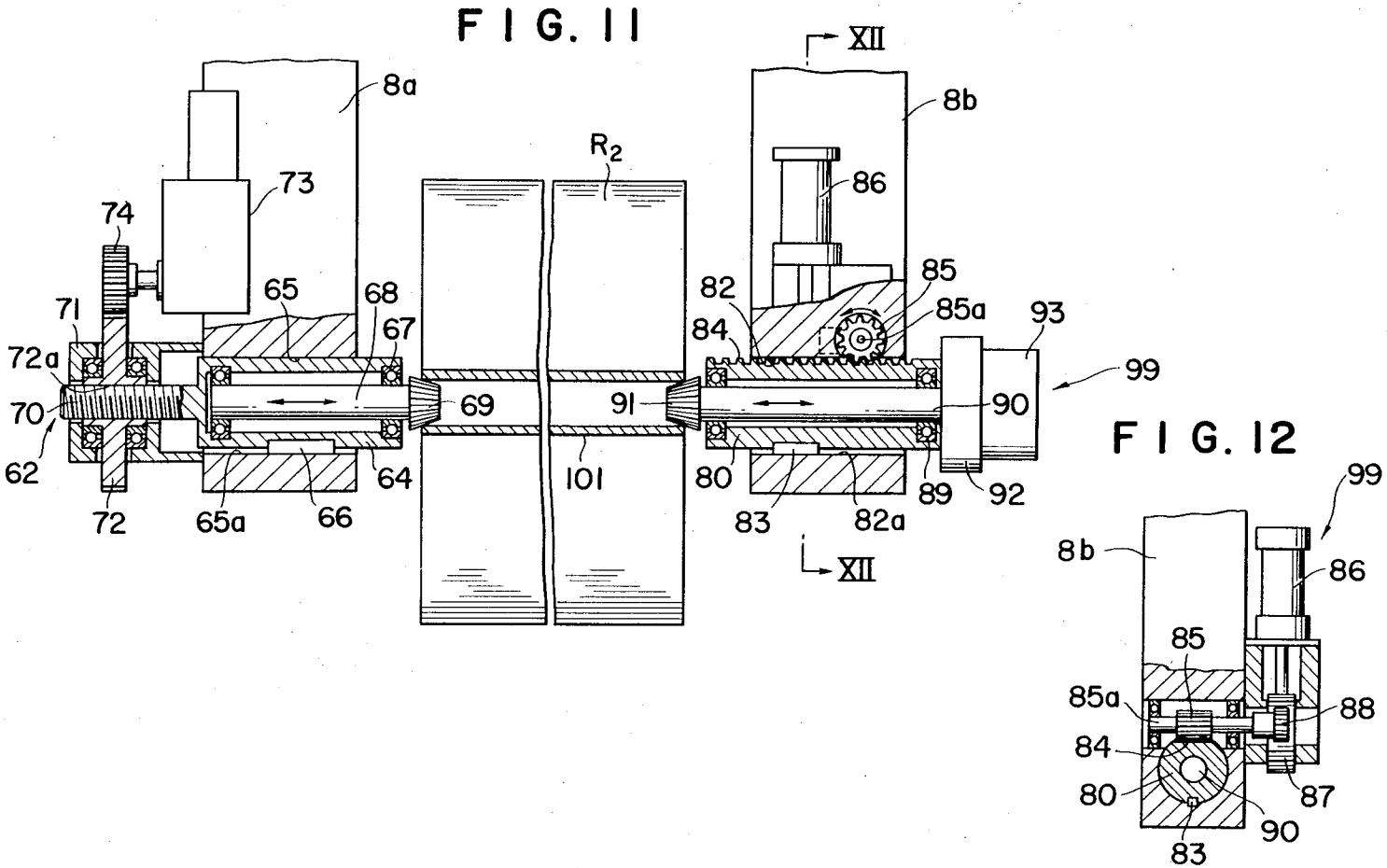
FIG. 11 is an enlarged, fragmentary elevation, partly sectioned for clarity, of the pair of roll holder arms together with one of the web rolls mounted thereon in the apparatus of FIG. 10, the view showing in particular the modified roll support mechanisms for adjustably varying the axial position of the web roll between the roll holder arms.
FIG. 12 is a section taken along the line XII—XII in FIG. 11.

As drawn on an enlarged scale in FIG. 11, the adjustable roll support mechanism 62 on the left hand roll holder arm 8*a* includes a sleeve 64 slidably received in a transverse bore 65 defined in one end of the roll holder arm. The sleeve 64 has a key 66 embedded therein and slidably engaged in a keyway 65*a* in the roll holder arm 8*a*, so that the sleeve 64 is constrained to longitudinal sliding motion relative to the roll holder arm 8*a* toward and away from the other roll holder arm 8*b*. A spindle 68 is rotatably mounted in the sleeve 64 via a pair of bearings 67. Projecting inwardly, or toward the other roll holder arm 8*b*, out of the sleeve 64, one ned of the spindle 68 rigidly carries a chucking cone 69 thereon.

The outer end of the sleeve 64 is closed and integrally provided with a threaded rod 70 in coaxial relation thereto. The threaded rod 70 is engaged in a tapped bore 72*a* defined axially through a driven gear 72 rotatably supported by a support structure 71 affixed to the roll holder arm 8*a*. The driven gear 72 meshes with a drive pinion 74 on the output shaft of a motor drive unit 73 mounted to the roll holder arm 8*a*.

Thus the bidirectional rotation of the motor drive unit 73 results in the back and forth travel of the sleeve 64 relative to the roll holder arm 8*a* in a direction parallel to the rotary shaft 4. The spindle 68 with its chucking cone 69 also travels back and forth with the sleeve 64.

As will be noted by referring back to FIG. 10, the other adjustable roll support mechanism 63 on the left hand roll holder arm 8*a* is of like construction. It comprises a spindle 76 carrying a chucking cone 75 and received in a sleeve 164, and a motor drive unit 77 for adjustably moving the spindle 76 back and forth with the sleeve 65 via intermeshing gears 78 and 79.

FIG. 11 also shows in detail one of the complementary pair of roll support mechanisms 99 and 100 on the right hand roll holder arm 8*b*. The illustrated representative roll support mechanism 99 includes a sleeve 80 slidably received in a transverse bore 82 defined in one end of the roll holder arm 8*b*. The sleeve 80 has a key 83 embedded therein and slidably engaged in a keyway 82*a* in the roll holder arm 8*b*, so that the sleeve is restrained from rotation relative to the roll holder arm but is slidable longitudinally relative to the same toward and away from the other roll holder arm 8*a* in a direction parallel to the rotary shaft 4.

As will be seen also from FIG. 12, the sleeve 80 has a set of rack teeth 84 formed longitudinally thereon to mesh with a pinion 85. This pinion is rigidly mounted on a shaft 85*a* rotatably mounted on the roll holder arm 8*b*. The shaft 85*a* has another pinion 88 non-rotatably mounted thereon, which pinion meshes with a rack 87 coupled to an air cylinder 86 on the roll holder arm 8*b*.

A spindle 90 is rotatably mounted in the sleeve 80 via a pair of bearings 89. The spindle 90 carries a chucking cone 91 on its inner end in opposed relation to the chucking cone 69 of the adjustable roll support mechanism 62. The outer end of the spindle 90 is coupled to a motor drive unit 93 via an electromagnetic clutch 92, which are both mounted on the sleeve 80 for joint back and forth travel therewith.

With reference again to FIG. 10 the other roll support mechanism 100 on the right hand roll holder arm 8*b* is of like configuration. It comprises a spindle 98 carrying a chucking cone 97 and rotatably received in a sleeve 81, an air cylinder 94 acting on the sleeve 81 via the rack and pinion mechanism, and a motor drive unit 96 coupled to the spindle 98 via an electromagnetic brake 95.

Figure 10:
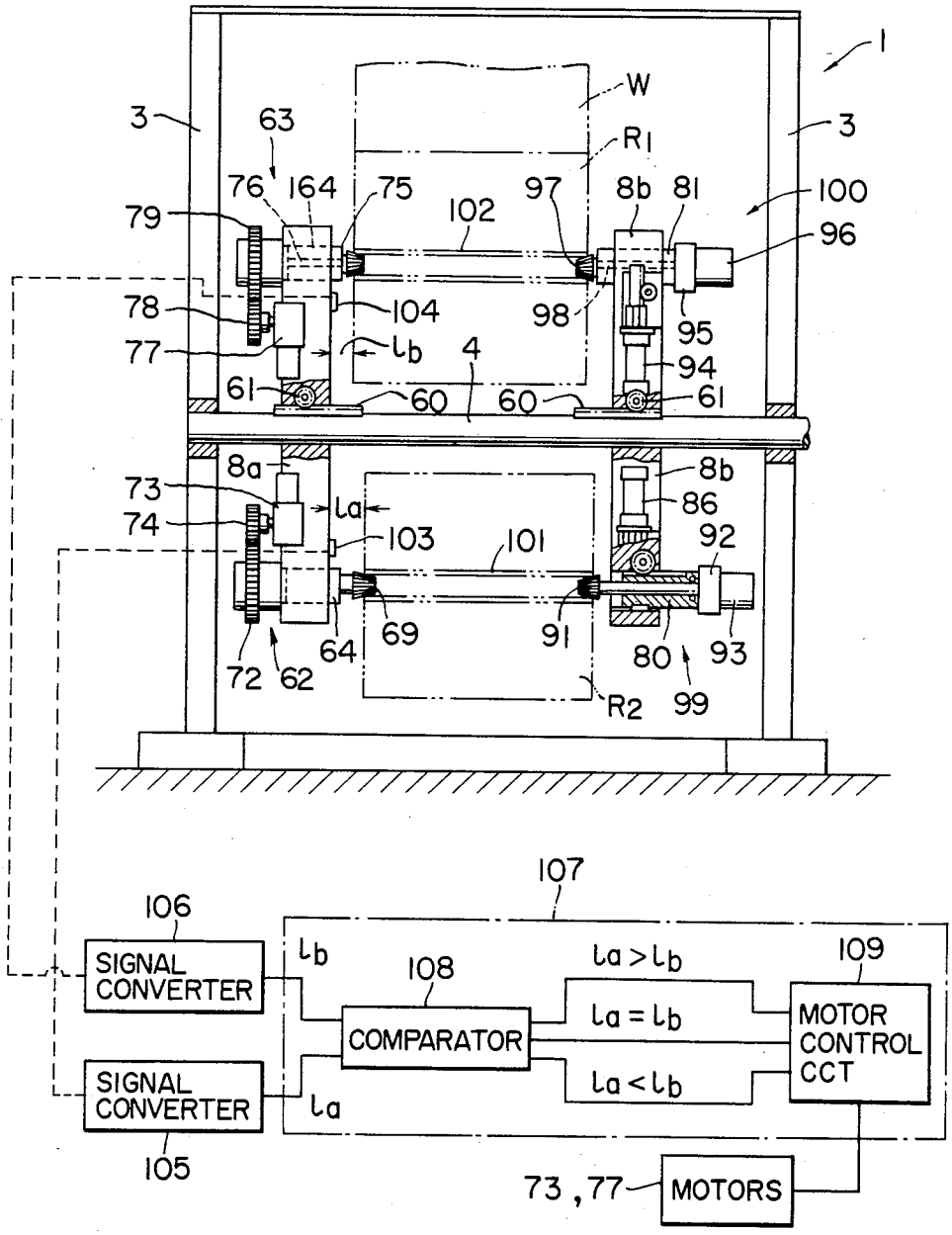
FIG. 10 is a view corresponding to FIG. 2 but showing another preferred form of the apparatus in accordance with the invention, which features means for aligning the successive web rolls, the apparatus being shown together with associated electronic control circuit in block diagrammatic form.

In FIG. 10 the old web roll R1 is shown supported by the adjustable support mechanism 62 and the opposed complementary roll support mechanism 100, with their chucking cones 75 and 97 engaged in the opposite ends of the hollow core 102 of the old web roll. The new web roll R2 is likewise supported by the other adjustable roll support mechanism 62 and the opposed complementary roll support mechanism 99, with their chucking cones 69 and 91 engaged in the opposite ends of the hollow core 101 of the new web roll.

With the old R1 and new R2 web rolls thus mounted on the opposite ends of the pair of roll holder arms 8*a* and 8*b*, the new web roll is to be adjustably moved axially by the motor drive unit 73 into alignment with the old web roll. The air cylinder 86 (94) of the complementary roll support mechanism 99 (100) functions to constantly bias the chucking cone 91 (97) leftwardly or inwardly, toward the opposed chucking cone 69 (75). Thus the new web roll R2 can be moved into alignment with the old web roll R1 merely by controlling the rotation of the motor drive unit 73 of the adjustable roll support mechanism 62 depending upon the relative axial positions of the old and new web rolls.

Such controlled rotation of the motor drive unit 72 (77) requires, first of all, the measurement of the relative distances $1_a$ and $1_b$ between either of the roll holder arms, 8*a* in this case, and the opposed ends of the old R1 and new R2 web rolls. Then the motor drive unit 73 (77) may be controlled according to the difference, if any, between the two distances $1_a$ and $1_b$ to adjust the axial position of the new web roll R2 to that of the old web roll R1.

FIG. 10 further illustrates electronic circuit for ascertaining the relative distances $1_a$ and $1_b$ between the roll holder arms 8*a* and the opposed ends of the web rolls R1 and R2 and for controlling the motor drive units 73 and 77 accordingly. Included are a pair of sensors 103 and 104 such as ultrasonic sensors or phototubes mounted to the inside surface of the roll holder arm 8*a* in symmetrical positions with respect to its axis of rotation, in opposed relation to the ends of the new R2 and old R1 web rolls respectively. If ultrasonic sensors are used as the sensors 103 and 104 they are connected in circuit with signal converters 105 and 106, respectively, of identical design. The converters 105 and 106 are both coupled to a control circuit 107 comprising a comparator 108 and motor control circuit 109. The comparator 108 compares the outputs from the signal converters 105 and 106 with each other, the signal converter outputs being representative of the outputs from the sensors 103 and 104, and delivers to the motor control circuit 109 an output signal corresponding to the difference, if any, between the signal converter outputs. In response to the comparator output the motor control circuit 109 causes the required one of the motor drive units 73 and 77 to rotate in a required direction so that the distances $1_a$and $1_b$ may become equal.

Figure 13:
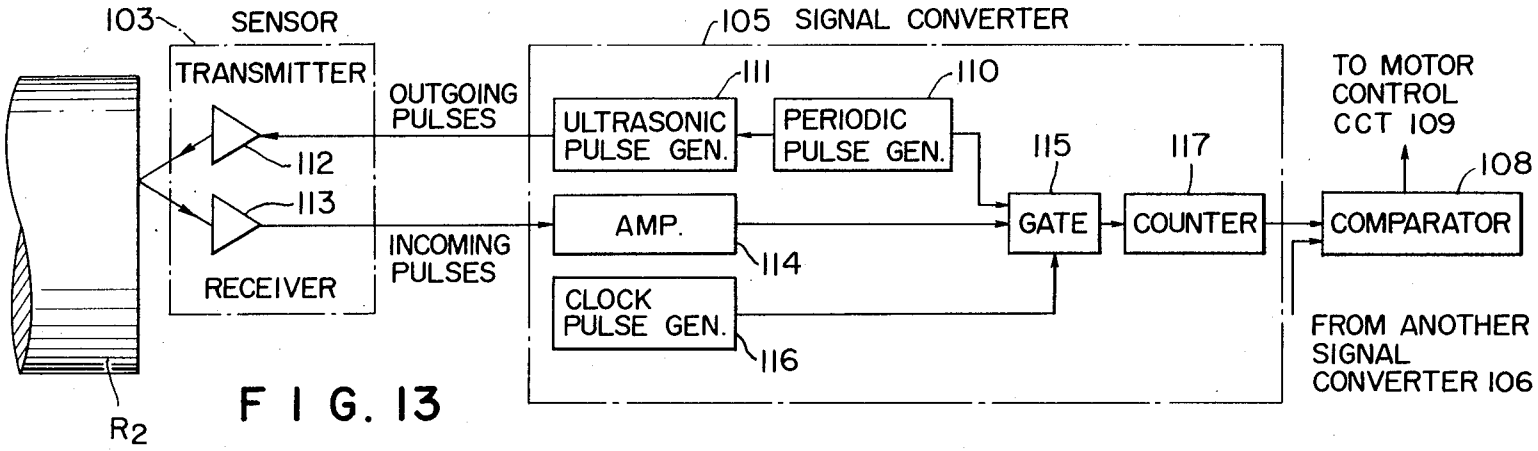
FIG. 13 is a block diagram of the electronic circuit for ascertaining the distance between one of the roll holder arms and the opposed end of one of the web rolls mounted thereon in the apparatus of FIG. 10.
Figure 14:
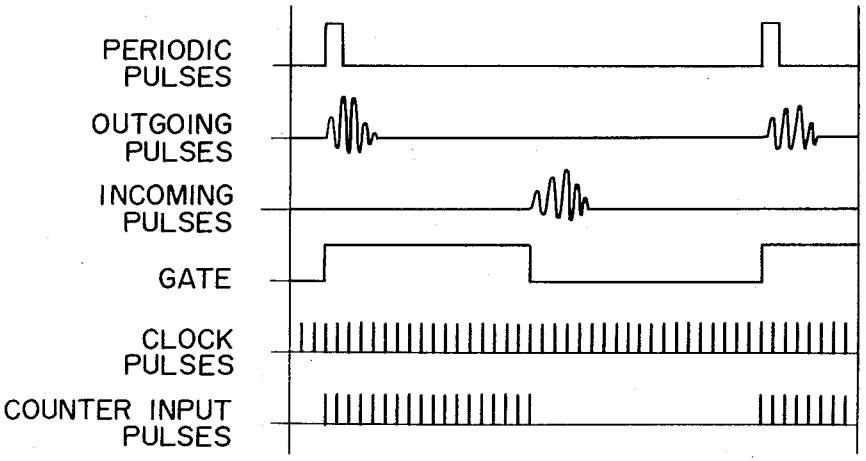
FIG. 14 is a diagram of waveforms useful in explaining the operation of the circuit of FIG. 13.

FIG. 13 illustrates in more detail an example of sensor 103 and an example of signal converter 105, it being understood that the other sensor 104 and signal converter 106 can be of like configurations. The sensor 103 has an ultrasonic pulse transmitter 112 for radiating ultrasonic waves directed toward one of the end faces of the web roll R2, and a receiver 113 for receiving the ultrasonic waves reflected back from the web roll.

The signal converter 105 includes an ultrasonic pulse generator 111 for delivering ultrasonic pulses to the transmitter 112 of the sensor 103 in response to periodic pulses from their generator 110, an amplifier 114 for amplifying the received ultrasonic pulses from the receiver 113 of the sensor 103, a gate 115 connected to input the periodic pulses from the generator 110, the amplified replica of the received ultrasonic pulses from the amplifier 114, and clock pulses from a clock pulse generator 116, and a counter 117 for counting the output pulses from the gate 115. The output from the counter 117 is fed to the comparator 108 of the control circuit 107, to which comparator is also applied the output from a counter in the other signal converter 106.

Operation of the Second Form

In the apparatus constructed as above described with reference to FIGS. 10 through 13, each new web roll R2 is to have its axial position adjusted to that of the old web roll R1 immediately on being mounted on the pair of roll holder arms 8*a* and 8*b*, while these arms are in the first preassigned angular position depicted in FIG. 6A. After the alignment of the new and old web rolls, in the manner set forth hereinbelow, the operation of the apparatus is analogous with that of the embodiment of FIGS. 1 through 7 which has been discussed with particular reference to FIGS. 6A through 6D.

The electronic circuit of FIGS. 10 and 13 is set into operation upon mounting of the new web roll R2 on the pair of roll holder arms 8*a* and 8*b*. In FIG. 10 the new web roll is shown supported by the adjustable roll support mechanism 62 and complementary roll support mechanism 99. Associated with the adjustable roll support mechanism 62 are the sensor 103 and signal converter 105 shown in detail in FIG. 13. The operation of these sensor and signal converter will be better understood by referring to the waveform diagram of FIG. 14.

As has been stated, the gate 115 of the signal converter 105 inputs the received ultrasonic pulses from the amplifier 114, the periodic pulses from the generator 110, and the clock pulses from the clock 116. The gate 115 permits the selective passage of the clock pulses therethrough, becoming open upon receipt of each periodic pulse from the generator 110 and closed upon receipt of each set of received ultrasonic pulses from the amplifier 114. The counter 117 counts the number of each train of output pulses from the gate 115 and delivers a corresponding output, which is representative of the distance $1_a$ between new web roll R2 and roll holder arm 8*a*, to one of the inputs of the comparator 108 of the control circuit 107.

Concurrently with the above operation of the sensor 103 and signal converter 105 a similar operation takes place with the other sensor 104 and signal converter 106. This signal converter delivers to the other input of the comparator 108 a signal representative of the distance $1_b$ between old web roll R1 and roll holder arm 8*a*.

If the outputs from both signal converters 105 and 106 are equal, no difference exists between the axial positions of the old R1 and new R2 web rolls. In that case the motor control circuit 109 holds the motor drive unit 73 of the adjustable roll support mechanism 62 out of rotation.

If the output from the signal converter 105 is less than the output from the other signal converter 106, the distance $1_a$ is smaller than the distance $1_b$. Then, in response to the corresponding output from the comparator 108, the motor control circuit 109 causes the motor drive unit 73 to rotate in a predetermined direction such that the sleeve 64 of the adjustable roll support mechanism 62 travels rightwardly, as viewed in FIGS. 10 and 11, together with the spindle 68 rotatably mounted therein. The new web roll R2 travels rightwardly with the spindle 68 against the bias of the air cylinder 86 of the roll support mechanism 99 acting on the spindle 70 carrying the right hand end of the new web roll. The motor control circuit 109 sets the motor drive unit 73 out of rotation when the distance $1_a$ becomes equal to the distance $1_b$. Now the two rolls R1 and R2 have been aligned.

If the output from the signal converter 105 is more than the output from the other signal converter 106, the distance $1_a$ is greater than the distance $1_b$. Then the motor control circuit 109 responds to the output from the comparator 108 by causing the motor drive unit 73 to rotate in a direction opposite to the aforesaid predetermined direction. Thereupon, with the retraction of the sleeve 64 of the adjustable roll support mechanism 62 into the bore 65 in the roll holder arm 8*a*, the new web roll R2 travels leftwardly under the bias of the air cylinder 86. The motor drive unit 73 is set out of rotation when the distance $1_a$ becomes equal to the distance $1_b$.

Figure 15:
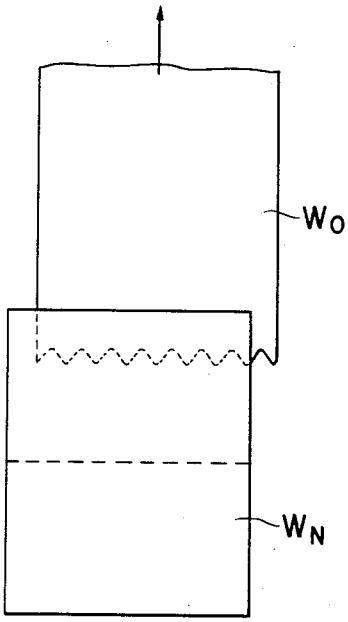
FIG. 15 shows two lengths of web spliced with their relative lateral displacement uncorrected.

Should the successive web rolls be spliced with their relative axial positions left uncorrected on the roll holder arms, the meeting ends of the old and new webs would be displaced laterally as in FIG. 15, where Wo and Wn denote the old and new webs respectively. This would give rise to the noted difficulties in the printing press or other machine into which the web is being fed. The apparatus of FIGS. 10 through 14 with its roll aligning mechanism obviates such difficulties and makes unnecessary the conventional manual aligning of the successive web rolls.

It will of course be understood that the above described adjustment of the axial position of the new web roll by the adjustable roll support mechanism 62 and complementary roll support mechanism 99 is by way of example only. When the old web roll R1 seen in FIG. 10 is used up and replaced by a new web roll, the axial position of this new web roll will be adjusted by the other adjustable roll support mechanism 63 and omplementary roll support mechanism 100.

It will also be seen that phototubes could be used instead of the ultrasonic sensors in the above embodiment. In that case the signal converters are not needed and the difference between the distances $1_a$ and $1_b$ are detected on the basis of the difference in light quantity which the receivers receive respectively.

Third Form

Figure 16:
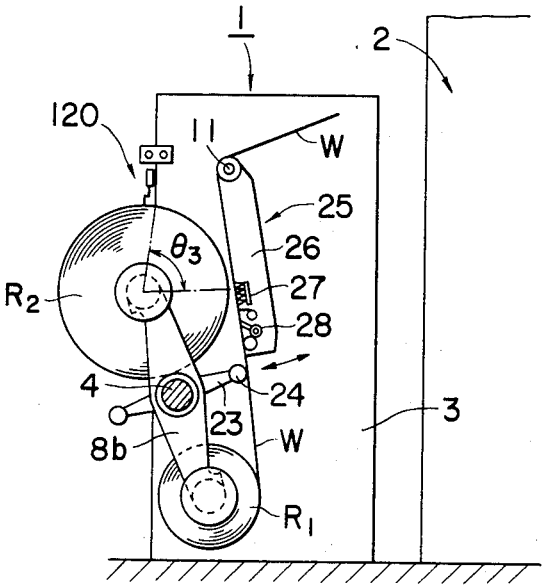
FIG. 16 is a view somewhat corresponding to FIG. 1 but showing still another preferred form of the apparatus in accordance with the invention, which features means for perforating pieces of tape attached to the leading web end of each new web roll, in order to assure ready tearing of the tape pieces upon splicing of the new web to the old web.
Figure 17:
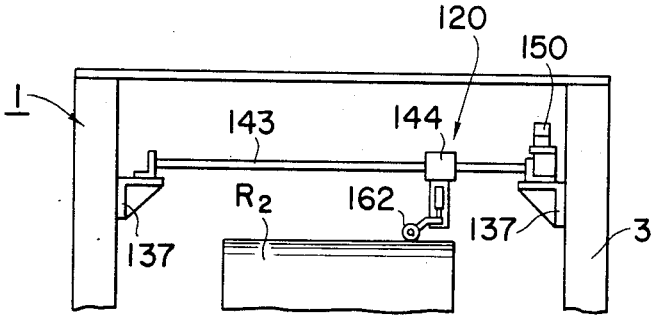
FIG. 17 is a fragmentary left hand side elevation of the apparatus fo FIG. 16.
Figure 18:
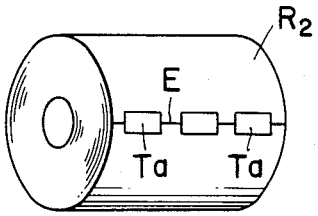
FIG. 18 shows in perspective a web roll intended for use with the apparatus of FIG. 16.

FIGS. 16 through 22 illustrate still another preferred form of the apparatus in accordance with the invention, which features a perforating mechanism seen at 120 in FIGS. 16 and 17. The perforating mechanism 120 is used for perforating one or more pieces of adhesive tape attached to each new web roll to retain the leading end of the web in position thereon, as pictured at Ta in FIG. 18. The adhesive tape Ta will hereinafter be referred to as the web end retainer tape. In FIG. 18 three pieces of web end retainer tape Ta are shown attached to the unused web roll R2 across the leading edge E of the web. The web end retainer tape is wider, and can be sturdier, than the tape t, FIG. 7, attached to each new web roll intended for use with the two foregoing forms of the apparatus in accordance with the invention.

Figure 19:
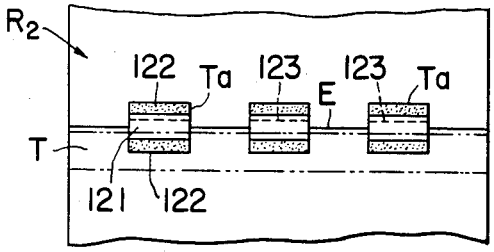
FIG. 19 is an enlarged, fragmentary elevation of the web roll of FIG. 18.

As shown on an enlarged scale in FIG. 19, each piece of web end retainer tape Ta has a central nonadhesive region 121 positioned across the leading web edge E, and a pair of adhesive regions 122 on opposite sides of the nonadhesive region which are attached to the web. Additional tape having adhesive layers on its opposite surfaces is attached to the leading end of the web, as indicated by the phantom outline designated T in FIG. 19, in overlying relation to parts of the web end retainer tape Ta in order to provide the adhesive region for use in splicing the new web roll to the old web.

Being wider and sturdier than the tape heretofore used to this end, the web end retainer tape Ta is not to easily break during the transportation of the web rolls or at the time of their mounting on the roll holder arms. However, the web retainer tape should readily break when each new web roll is spliced to the old by the method and apparatus of this invnetion. This becomes possible by creating a line of perforations or small incisions, as seen at 123 in FIG. 19, in each piece of web end retainer tape Ta by the perforating mechanism 120 after mounting the web roll in position on the apparatus. The perforations 123 are formed in the nonadhesive region 121 of the web end retainer tape Ta so as to extend along the edge E of the rolled web. Thus perforated, the web end retainer tape will tear easily after the splicing of the web roll via the adhesive region T thereon.

Figure 21:
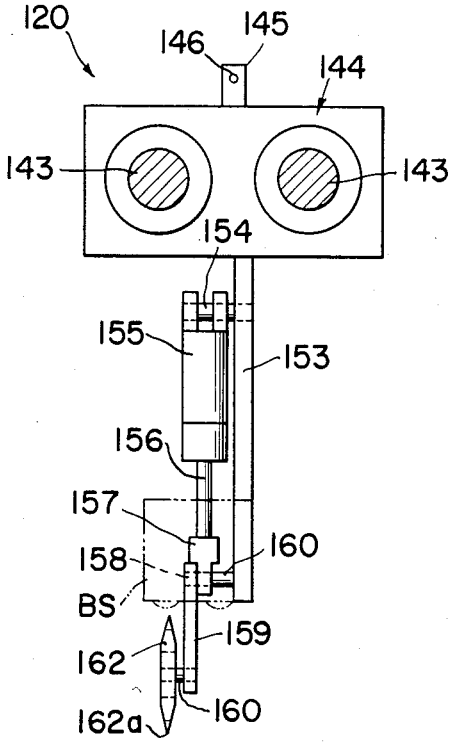
FIG. 21 is a section through the tape perforating mechanism, taken along the line XXI—XXI of FIG. 20.
Figure 20:
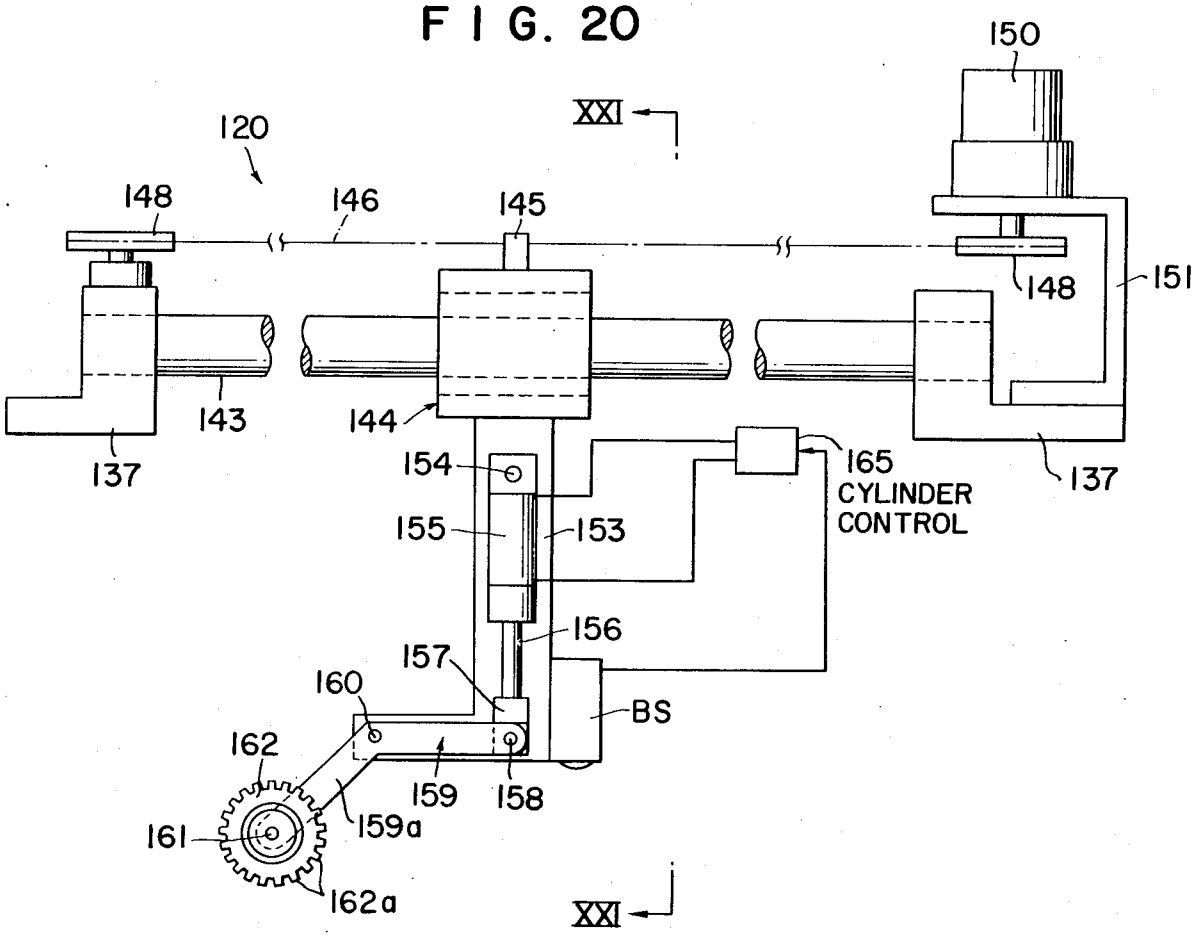
FIG. 20 is an enlarged elevation, partly broken away for illustrative convenience, of the tape perforating mechanism in the apparatus of FIG. 16.
Figure 22:
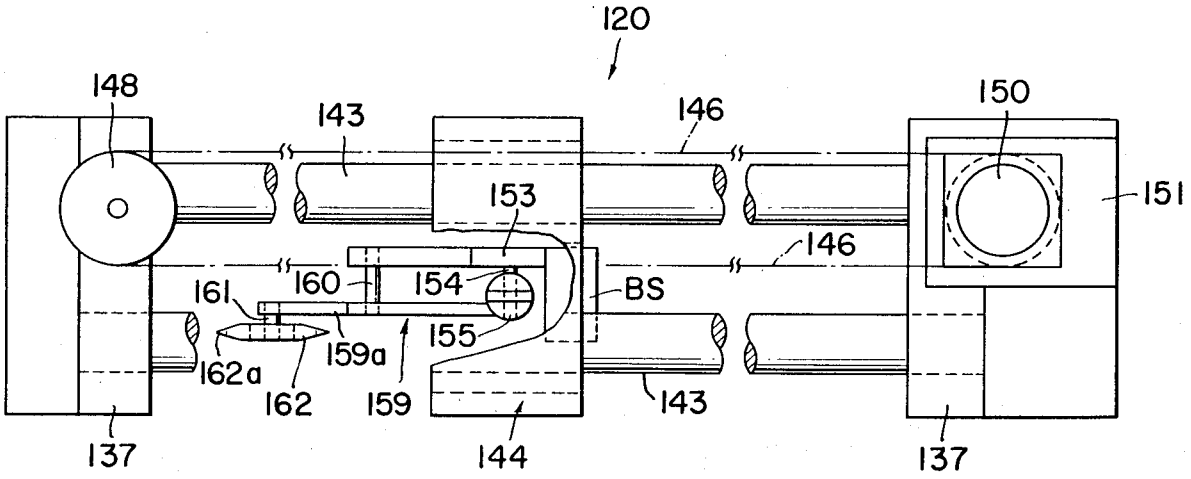
FIG. 22 is a top plan, with a part broken away to reveal other parts, of the tape perforating mechanism of FIG. 20.

While the perforating mechanism 120 appears in FIGS. 16 and 17, its details will be better understood from a study of FIGS. 20 through 22. It includes a pair of guide rods 143 extending horizontally in parallel spaced relation to each other, in a direction parallel to the rotary shaft 4, FIG. 16, carrying the pair of roll holder arms 8*a* and 8*b*, and having their opposite ends bracketed at 137 to the pair of side frames 3 of the apparatus.

Slidably mounted on the guide rods 143 is a carriage 144 carrying a rotary perforator 162 together with means for automatically moving the same between working and retracted positions on the carriage. For the movement of the carriage 144 along the guide rods 143 there is provided wire rope 146 having its opposite ends both anchored to a lug 145 on the carriage and extending along a pair of pulleys 148 on the respective brackets 137. While the left hand pulley 148, as seen in FIGS. 20 and 22, is mounted directly on the corresponding one of the brackets 137, the right hand pulley 148 is mounted on the output shaft of a motor drive unit 150 which is supported upstandingly on the other bracket 137 via a mount 151. The bidirectional rotation of the motor drive unit 150 results in the back and forth travel of the carriage 144 along the guide rods 143.

The carriage 144 has an L-shaped carrier arm 153 depending therefrom. On the carrier arm 153 a fluid actuated cylinder 155 of the double acting type is pivotally supported at its head end by a pivot 154 and so is disposed in a generally upright attitude. The cylinder 155 has a piston rod 156 extending downwardly therefrom and terminating in a coupling member 157, which is pin jointed at 158 to one of the angled arms of a bell crank 159. This bell crank is pivoted at the apex of its two arms on the extreme end of the L-shaped carrier arm 153 by a pin 160. The aforesaid rotary perforator 162 is rotatably mounted on the distal end of the other arm 159*a* of the bell crank 159 via a shaft 161.

The rotary perforator 162 is in the form of a wheel having a series of teeth 162*a* on its periphery. The teeth 162*a* are to be incised into the web end retainer tape Ta on each new web roll R2 supported by the roll holder arms as in FIG. 16, thereby creating a line of perforations therein.

With particular reference to FIG. 20 the L-shaped carrier arm 153 has also mounted thereon a phototube BS for optically sensing the three pieces of web end retainer tape Ta on the new web roll R2. The phototube BS is electrically connected to a cylinder control 165 of largely conventional make which controls the delivery of pressurized fluid to the opposed fluid chambers of the cylinder 155 in response to the output from the phototube. The cylinder control 165 has a built-in timer, not shown, for a purpose yet to be described. The contraction and extension of the cylinder 155 results, of course, in the movement of the rotary perforator 162 into and out of perforating engagement with the web end retainer tape Ta on the new web roll R2.

It will be understood from a consideration of FIG. 16 that, although not specifically illustrated, the other details of construction of the FIGS. 16 through 22 apparatus are substantially analogous with those of the two preceding forms of the apparatus.

Operation of the Third Form

The new web roll R2 with the web end retainer tape Ta attached in place thereto is mounted on the pair of roll holder arms 8*a* and 8*b* while these are in the first preassigned angular position of FIG. 6A or 6D. Toward the end of web delivery from the old web roll R1 the roll holder arms are turned to the second preassigned angular position of FIG. 6B, as has been stated in conjunction with the embodiment of FIGS. 1 through 7. FIG. 16 also shows the roll holder arms in this second preassigned angular position, with the new web roll R2 held opposite to the web traveling from the old web roll R1 past the splicer mechanism 25.

In the second preassigned angular position of the roll holder arms 8*a* and 8*b* the new web roll R2 is revolved about its own axis until the web end retainer tape Ta thereon comes just under the perforating mechanism 120. The carriage 144 of the perforating mechanism is now assumed to be in the extreme left hand position, as viewed in FIGS. 17, 20 and 22, on the guide rods 143.

Then the motor drive unit 150 is set into rotation in a predetermined direction to cause the rightward travel of the carriage 144 along the guide rods 143. Traveling rightwardly with the carriage 144, the phototube BS delivers to the cylinder control 165 a signal indicative of the presence or absence of the three pieces of web end retainer tape Ta thereunder. Since the rotary perforator 162 lags behind the phototube BS during the rightward travel of the carriage 144, the unshown timer built into the cylinder control 165 causes contraction of the cylinder 155 upon lapse of a preset length of time following the detection of each piece of web end retainer tape by the phototube BS. Upon contraction of the cylinder 155 the bell crank 159 is pivoted in a counterclockwise direction, as seen in FIG. 20, thereby causing the rotary perforator 162 to cut into the detected piece of web end retainer tape and hence to create the line of perforations 123, FIG. 19, in its nonadhesive region 121 by rolling thereover. Upon lapse of another preset length of time, when the rotary perforator 162 has completed the perforation of the particular piece of web end retainer tape, the cylinder control 165 causes the cylinder 155 to extend for moving the rotary perforator out of engagement with the web roll.

The perforating mechanism 120 repeats the foregoing operation upon detection of each of the successive pieces of web end retainer tape Ta by the phototube BS. After the rotary perforator 162 has perforated all the web end retainer tape pieces, the motor drive unit 150 is reversed in rotation to move the carriage 144 back to the initial position, where a limit switch, not shown, is activated to set the motor drive unit out of rotation.

Immediately following the perforation of all the web end retainer tape pieces, the new web roll R2 is revolved about its own axis, as by one of the clutch motors 15 seen in FIG. 2, through a predetermined angle $\theta 3$, FIG. 16, in a clockwise direction as seen in this latter figure. This clockwise rotation of the new web roll through the predetermined angle is intended to bring the adhesive region T thereon to a position of register with the splicer brush 27 of the splicer mechanism 25. Therefore, as has been explained with reference to FIGS. 6B and 6C, the new web roll can then be spliced to the web traveling therepast from the old web roll R1. The leading end of the new web will readily come off the roll on being spliced to the old web as then the pieces of web end retainer tape Ta will tear along the lines of perforations 123.

In connection with the above embodiment incorporating the perforating mechanism 120, attention is again called to the fact that the lines of perforations 123 are cut in the nonadhesive regions 121 of the web end retainer tape pieces Ta, which regions are positioned across the leading edge E of the rolled web. Accordingly the web end retainer tape pieces will tear easily despite some possible error in the positioning of the tape pieces with respect to the rotary perforator 162 in the circumferential direction of the web roll, only if the perforations are formed in the nonadhesive regions of the tape pieces.

It is to be understood that the three forms of the apparatus, as well as the modifications thereof, selected to exemplify the present invention have been disclosed with the thought of pictorially presenting the improved principles of uninterruptedly feeding a continuous web of paper or like material into any desired web consuming or processing machine by splicing successive web rolls. A variety of additional modifications and alterations will readily occur to one skilled in the art to conform to system requirements or design preferences without departing from the scope of the invention as expressed in the following claims.

What is claimed is:

1. Apparatus for splicing successive web rolls to feed a continuous web of paper or like material into a web consuming or processing machine comprising:

(a) an infeed mechanism comprising:

(1) a pair of roll holder arms extending in parallel spaced relation to each other and medially pivoted for joint rotation, the roll holder arms rotatably carrying on their opposite ends an old web roll from which the web is delivered into the web consuming or processing machine and a new web roll to be spliced to the web from the old web roll;

(2) firs drive means for controllably revolving the roll holder arms, the roll holder arms being held in a first preassigned angular position during the web delivery from the old web roll and, toward the end of the web delivery from the old web roll, being revolved by the first drive means to a second preassigned angular position where the web from the old web roll travels close to the periphery of the new web roll;

(3) second drive means for controllably revolving each of the old and new web rolls relative to the roll holder arms;

(4) electronic sensor means coacting with the second drive means for bringing an adhesive region on the leading web end of the new web roll to a preassigned angular position opposite to the web traveling from the old web roll past the new web roll when the roll holder arms are in the second preassigned angular position; and (5) brake means for controlling the rotation of each of the old and new web rolls relative to the roll holder arms, the brake means arresting the rotation of the old web roll after the adhesive region on the new web roll comes to the preassigned angular position opposite to the web from the old web roll;

(b) a splicer mechanism located near the new web roll normally held in a retracted position away from the roll holder arms and, when the roll holder arms are revolved from the first to the second preassigned angular position, moved to a working position for pressing the web from the old web roll against the adhesive region on the new web roll while said new web roll is held in the second preassigned angular position; and (c) a web storage mechanism interposed between the infeed mechanism and the web consuming or processing machine for normally storing therein a prescribed length of the web from the old web roll, the stored length of the web being fed into the web consuming or processing machine during the splicing of the old and new web rolls.

2. The apparatus of claim 1 wherein the splicer mechanism comprises:

(a) frame means movable between the retracted and working positions;

(b) a splicer brush on the frame means for pressing the web from the old web roll against the adhesive region on the new web roll; and (c) a cutter on the frame means for cutting off an excess length of the web from the old web roll behind the adhesive region on the new web roll after the pressing of the old web against the adhesive region.

3. The apparatus of claim 1 wherein said electronic sensor means of the infeed mechanism comprises:

(a) a fixed sensor element for sensing the adhesive region on the new web roll; and (b) control circuit means responsive to an output signal from the sensor element for causing the second drive means to revolve the new web roll relative to the roll holder arms through a preset angle following the detection of the adhesive region by the sensor element.

4. The apparatus of claim 1 wherein the new web roll has an optically recognizable mark attached to one of its opposite ends in a predetermined position thereon related to the position, of the adhesive region thereon, and wherein said electronic sensor means comprises a pair of sensor elements mounted to one of the roll holder arms for sensing the marks on new web rolls to be successively mounted on the roll holder arms.

5. The apparatus of claim 1 wherein the new web roll has an optically recognizable mark attached to one of its opposite ends in a predetermined position thereon related to the position of the adhesive region thereon, and wherein said electronic sensor means comprises a sensor element mounted to the splicer mechanism for sensing the mark on the new web roll.

6. The apparatus of claim 1 wherein the pair of roll holder arms of the infeed mechanism are both fixedly mounted on a rotary shaft, and wherein the first drive means comprises:

(a) a motor drive unit for rotating the rotary shaft; and (b) switch means responsive to the rotation of the rotary shaft for setting the motor drive unit out of rotation in the preassigned angular positions of the roll holder arms.

7. The apparatus of claim 1 further comprising means for adjusting the axial position of the new web roll on the roll holder arms to the axial position of the old web roll thereon preparatory to splicing them.

8. The apparatus of claim 7 wherein the means for adjusting the relative axial positions of the old and new web rolls on the roll holder arms comprises:

(a) a pair of adjustable roll support mechanisms mounted on the opposite ends of one roll holder arm each for supporting one end of one web roll, each adjustable roll support mechanism being capable of adjustably moving one web roll axially relative to the roll holder arms;

(b) a pair of complementary roll support mechanisms mounted on the opposite ends of the other roll holder arm each for supporting the other end of one web roll, each complementary roll support mechanism biasing one web roll axially toward the opposed one of the adjustable roll support mechanisms;

(c) a pair of transmitter-sensors for ascertaining the distances between one of the roll holder arms and the opposed ends of the old and new web rolls; and (d) circuit means for comparing outputs from the sensors and for causing one of the adjustable roll support mechanisms to move the new web roll axially until the difference between the outputs from the sensors becomes zero.

9. The apparatus of claim 8 wherein each of the pair of adjustable roll support mechanisms comprises:

(a) a sleeve mounted to one end of said one roll holder arm and constrained to longitudinal motion relative to the roll holder arm in the axial direction of one web roll;

(b) a spindle rotatably mounted in the sleeve and having one end adapted for engagement in a hollow core of one web roll; and (c) drive means on said one roll holder arm for adjustably moving the sleeve longitudinally together with the spindle rotatably mounted therein.

10. The apparatus of claim 8 wherein each of the pair of complementary roll support mechanisms comprises:

(a) a sleeve mounted to one end of said other roll holder arm and constrained to longitudinal motion relative to the roll holder arm in the axial direction of one web roll;

(b) a spindle rotatably mounted in the sleeve and having one end adapted for engagement in a hollow core of one web roll; and (c) an air cylinder on said other roll holder arm for biasing the sleeve, together with the spindle rotatably mounted therein, toward the opposed one of the adjustable roll support mechanisms.

11. The apparatus of claim 8 wherein the circuit means of the adjusting means comprises:

(a) a pair of signal converters connected one to each sensor for translating the outputs from the sensors into signals that can be compared with each other electrically;

(b) a comparator for comparing the output signals from the signal converters with each other; and (c) a control circuit responsive to an output from the comparator for causing one of the adjustable roll support mechanisms to move the new web roll axially so as to make zero the difference between the outputs from the sensors.

12. The apparatus of claim 11 wherein each of said transmitter-sensor of the adjusting means comprises a transmitter for radiating ultrasonic waves directed toward one end of one of the web rolls on the roll holder arms, and a receiver for receiving the ultrasonic waves reflected back from the one web roll, the receiver putting out corresponding ultrasonic pulses upon reception of the reflected ultrasonic waves, and wherein each signal converter comprises:

(a) a periodic pulse generator for generating periodic pulses;

(b) an ultrasonic pulse generator responsive to each periodic pulse from the periodic pulse generator for generating a set of ultrasonic pulses for delivery to the transmitter of one sensor;

(c) a clock pulse generator for generating a succession of clock pulses;

(d) a gate connected to receive the periodic pulses from the periodic pulse generator, the ultrasonic pulses from the receiver of one sensor, and the clock pulses from the clock pulse generator, the gate permitting the passage therethrough of the clock pulses during the period from the reception of one periodic pulse from the periodic pulse generator to the reception of one set of ultrasonic pulses from the receiver; and (e) a counter for counting the number of the clock pulses that have passed the gate.

13. The apparatus of claim 1 wherein the new web roll has web end retainer tape attached thereto for holding the leading web end in position thereon, and wherein the apparatus further comprises a perforating mechanism for creating a line of perforations in the web end retainer tape preparatory to the splicing of the new web roll to the old web.

14. The apparatus of claim 13 wherein the perforating mechanism comprises:

(a) guide means extending parallel to the axis of the new web roll on the roll holder arms;

(b) a carriage movable along the guide means; and (c) a perforator on the carriage for perforating the web end retainer tape on the new web roll with the travel of the carriage along the guide means.

15. The apparatus of claim 14 wherein the new web roll has a plurality of pieces of web end retainer tape attached thereto, and wherein the perforating mechanism further comprises:

(a) an actuator on the carriage for moving the perforator into and out of perforating engagement with the pieces of web end retainer tape on the new web roll;

(b) a electronic tape sensor on the carriage for detecting the successive pieces of web end retainer tape with the travel of the carriage along the guide means; and (c) actuator control means associated with the tape sensor for causing the actuator to move the perforator into perforating engagement with each piece of web end retainer tape upon detection thereof by the tape sensor.

16. The apparatus of claim 15 wherein the perforator lags behind said electronic tape sensor during the travel of the carriage in a predetermined direction along the guide means, and wherein the actuator control means is adapted to cause the actuator to move the perforator into perforating engagement with each piece of web end retainer tape with a prescribed time delay following the detection thereof by said electronic tape sensor.

* * * * *